US012643760B2

(12) United States Patent
Vannucchi

(10) Patent No.: US 12,643,760 B2
(45) Date of Patent: Jun. 2, 2026

(54) STACKER FOR STACKING SHEETS, AND RELATED METHOD

(71) Applicant: FOSBER S.P.A., Pescaglia (IT)

(72) Inventor: Lorenzo Vannucchi, Pescaglia (IT)

(73) Assignee: Fosber S.p.A., Pescaglia (IT)

( * ) Notice: Subject to any disclaimer, the term of this patent is extended or adjusted under 35 U.S.C. 154(b) by 160 days.

(21) Appl. No.: 18/374,357

(22) Filed: Sep. 28, 2023

(65) Prior Publication Data

US 2024/0124256 A1 Apr. 18, 2024

(30) Foreign Application Priority Data

Oct. 17, 2022 (IT) ..... 102022000021312

(51) Int. Cl.

| | |
|---|---|
| ***B65H 31/24*** | (2006.01) |
| ***B65H 29/58*** | (2006.01) |
| ***B65H 31/10*** | (2006.01) |
| ***B65H 33/12*** | (2006.01) |

(52) U.S. Cl.

CPC ..... *B65H 31/24* (2013.01); *B65H 31/10* (2013.01); *B65H 2301/4212* (2013.01); *B65H 2301/4217* (2013.01); *B65H 2404/2691* (2013.01)

(58) Field of Classification Search

CPC ..... B65H 33/08; B65H 33/12; B65H 33/16; B65H 31/24; B65H 31/10; B65H 31/20; B65H 31/12; B65H 31/3054; B65H 29/66; B65H 29/58; B65H 29/18; B65H 2301/4212; B65H 2301/4217; B65H 2301/42194; B65H 2301/42172; B65H 2701/1762; B65G 57/035; B65G 57/03; B65G 57/11; B65G 57/112

See application file for complete search history.

(56) References Cited

U.S. PATENT DOCUMENTS

| | | | | |
|---|---|---|---|---|
| 5,829,951 | A * | 11/1998 | Adami | B65H 33/12 414/790.7 |
| 10,377,602 | B2 | 8/2019 | Adami | |
| 2005/0280203 | A1* | 12/2005 | Ozcariz Eizaguirre | B65H 33/16 271/214 |
| 2007/0102875 | A1* | 5/2007 | Maierhofer | B65H 29/242 271/302 |
| 2014/0353119 | A1* | 12/2014 | Wu | B65H 33/08 198/431 |
| 2017/0088369 | A1* | 3/2017 | Adami | B65H 31/10 |

(Continued)

FOREIGN PATENT DOCUMENTS

| | | |
|---|---|---|
| CN | 202245502 U | 5/2012 |
| DE | 102004051243 A1 | 5/2006 |
| EP | 0557255 A1 | 8/1993 |

(Continued)

OTHER PUBLICATIONS

Italy Patent Office Search Report and Written Opinion, Application No. 2022000021312 filed Oct. 17, 2022.

*Primary Examiner* — Luis A Gonzalez

(74) *Attorney, Agent, or Firm* — Breiner & Breiner, L.L.C.

(57) ABSTRACT

The stacker comprises two stacking platforms and a system for conveying corrugated board sheets, configured to discharge the sheets alternatively onto one or the other of the two stacking platforms. A switching device allows for a quick switch of the conveyor system from one to the other of two operating conditions.

22 Claims, 10 Drawing Sheets

(56) References Cited

U.S. PATENT DOCUMENTS

| | | | | |
|---|---|---|---|---|
| 2018/0273332 | A1* | 9/2018 | Adami | B65H 31/3054 |
| 2022/0227593 | A1* | 7/2022 | Bae | B65H 31/3063 |

FOREIGN PATENT DOCUMENTS

| | | | |
|---|---|---|---|
| EP | 0792831 | A1 | 9/1997 |
| EP | 3147244 | A1 | 3/2017 |
| EP | 3147245 | A1 | 3/2017 |
| EP | 3378810 | A1 | 9/2018 |
| EP | 3378811 | A1 | 9/2018 |
| EP | 3378813 | A1 | 9/2018 |
| JP | H01139467 | A | 5/1989 |

* cited by examiner

STACKER FOR STACKING SHEETS, AND RELATED METHOD

TECHNICAL FIELD

The invention relates to sheet stacking devices and methods, useful for forming stacks of sheets, for example, but not exclusively, corrugated board sheets. Specifically, embodiments described herein relate to corrugated board sheet stackers and stacking methods adapted to form stacks of sheets containing a plurality of orders of sheets and/or stacks containing a limited number of sheets.

Background Art

In some industrial sectors there is a need for stacking sheets, for example corrugated board sheets. To this end, different types of stackers have been disclosed, that form stacks of sheets, stacked for example on a pallet, which are then packaged and shipped. Examples of stackers are disclosed in U.S. Ser. No. 10/377,602, EP3378811, EP3378813, EP3147245, EP3147244, EP3147244, EP792831, EP792831, EP3378810.

In the paper industry, corrugated board sheets are manufactured starting from a continuous web-like corrugated board material, which is cut longitudinally and divided into strips. Each strip is further divided transversely to generate a plurality of sheets of desired length. The sheets that have been obtained are then delivered to a so-called stacker, which forms stacks or bundles of sheets. The stacks are subsequently delivered to the final user, for example for manufacturing corrugated board boxes or the like.

A corrugated board web is usually formed by combining at least two flat paper webs and at least one fluted paper web. The fluted paper sheets are usually obtained by corrugating a flat paper web between two corrugating rollers that mesh with each other. Usually, a corrugated board web comprises at least one fluted paper web arranged between two flat paper webs, aka "liners". The liners are glued to the fluted paper web by means of a glue applied to the crests of the flutes of the fluted paper web. A corrugated board web sometimes comprises more than two fluted paper webs. In this case, intermediate liners are arranged between two fluted paper webs. The flutes of the fluted paper webs can differ in terms of height and/or sizes. Different flutes are used to give different mechanical features to the final corrugated board sheet.

Fast advancing sheets must be carefully stacked to form stacks of regular shape. Known stackers usually comprise a sheet conveyor arrangement, which receives a substantially continuous flow of sheets that are shingled and delivered onto a stacking surface in a stacking bay.

In some cases, each stack is formed of corrugated board sheets that are equal and aligned to one other to form a stack of parallelepiped shape. In other cases, each stack is formed of staggered bundles, each bundle containing a predetermined number of sheets. EP3378811 discloses a stacker that forms stacks of mutually staggered bundles.

Corrugated board sheets are manufactured according to orders. Each order contains a number of identical corrugated board sheets. An order can include a large number of sheets, i.e. many tens or even hundreds of sheets, which can be stacked in one or more identical stacks.

However, in some cases smaller orders shall be processed. Sometimes, for example, small orders of a few dozen sheets are required. Orders may differ from one another in the type of liners and flutings, as well as in the size of the sheets.

Even if a stack is usually comprised of identical sheets belonging to the same order, however in some cases it may be advantageous to group different orders in a single stack, to save space along the conveyors and in the storage areas and to decrease the number of evacuations, thus increasing the machine speed performance. When different orders are stacked in the same stack, each order is formed by a bundle of identical sheets. Stacked bundles may be formed of sheets of different lengths, so that an order in the stack may overhang from the previous or from the next order. This can affect the stability of the stack. In order to prevent the stack from collapsing, the difference in length between sheets of orders collected in the same stack cannot be greater than a predetermined value. Thus, the possibility of stacking different orders on the same stack is limited.

EP3378813 discloses a stacker configured to form stacks of corrugated board sheets, which collect sheets of different orders, grouped in bundles of different shapes and sizes.

One of the critical aspects of the known stackers is the transitory step of removing the formed stack from the stacking bay. For removing the stack, a gap shall be formed in the normally continuous flow of corrugated board sheets delivered from the sheet conveyor arrangement to a stacking platform provided in a stacking bay. The longer the time required to remove a formed stack from the stacking bay is, the greater shall be the gap in the flow of sheets. This transitory step slows down the operation of the stacker, thus adversely affecting the production speed. Furthermore, forming a large gap in the flow of sheets can be difficult.

Therefore, there is the need to provide sheet stackers and stacking methods that overcome or at least partially alleviates one or more of the drawbacks of the known stacking devices and methods.

SUMMARY

According to one aspect, a stacker for stacking sheets is provided, including a first conveyor having an entrance end and a discharge end for the sheets. A first stacking platform is associated with the first conveyor, arranged such as to receive sheets discharged from the discharge end of the first conveyor. The first stacking platform is provided with a vertical lifting and lowering movement to allow forming stacks of sheets on the first stacking platform.

Along the first conveyor, a device is provided for forming a gap in a flow of shingled sheets moving forward along the first conveyor.

The stacker also comprises a second conveyor, having an entrance end and a discharge end for the sheets and arranged in series with the first conveyor. A second stacking platform is associated with the second conveyor, arranged to receive sheets discharged from the discharge end of the second conveyor. The second stacking platform is provided with a vertical lifting and lowering movement to allow forming stacks of sheets on the second stacking platform.

A switching device is arranged near the discharge end of the first conveyor and the entrance end of the second conveyor. The switching device is adapted to move the first conveyor and the second conveyor so as to arrange the discharge end of the first conveyor and the entrance end of the second conveyor selectively: in a first position, where the discharge end of the first conveyor is misaligned relative to the entrance end of the second conveyor and positioned to discharge sheets from the first conveyor onto the first stacking platform; and in a second position, where the discharge end of the first conveyor is aligned with the entrance end of the second conveyor to convey the sheets from the entrance of the first conveyor along the first and the second conveyors and to discharge the sheets onto the second stacking platform.

The stacker switches from the first position to the second position very quickly, so as to switch from a phase, in which a stack of corrugated board sheets is formed on the first stacking platform, to a phase, in which a stack of corrugated board sheets is formed on the second stacking platform. The stacking platform, which temporarily does not receive new sheets to stack, can perform the operations necessary to evacuate the previously formed stack. Switching from one to the other of the two positions of the conveyors requires a very short gap in the flow of sheets delivered by the stacker. Each stack is evacuated from the stacking platform on which it has been formed in so-called masked time, i.e. in while the stacker continues to stack sheets on the other stacking platform.

The stacker is configured as a so-called "downstacker", wherein the first stacking platform is provided with a lifting and lowering movement with respect to the discharge end of the first conveyor, to form stacks of sheets on the first stacking platform through a gradual lowering movement of the first stacking platform, and wherein the second stacking platform is provided with a lifting and lowering movement with respect to the discharge end of the second conveyor, to form stacks of sheets on the second stacking platform through a gradual lowering movement of the second stacking platform.

Advantageously, an auxiliary conveyor can be associated with the first conveyor; the auxiliary conveyor is provided in a position which is stationary with respect to the stacking bay, receives the sheets from the discharge end of the first conveyor and transfers them onto the stacking platform.

Advantageously, to reduce the footprint of the stacker, an evacuation platform can be provided in an intermediate position between a first stacking bay, where the first stacking platform is arranged, and a second stacking bay, where the second stacking platform is arranged. The evacuation platform is adapted to receive stacks of sheets from at least one of the first stacking platform and the second stacking platform, and preferably from both the first stacking platform and the second stacking platform.

Further advantageous features and embodiments of the stacker disclosed herein are illustrated below with reference to the accompanying drawings, and are defined in the appended claims.

According to a further aspect, the invention relates to a method for forming stacks of cardboard sheets, especially corrugated board sheets. According to embodiments disclosed herein, the method comprises the steps of:

a) conveying a flow of shingled sheets along a first conveyor extending from an entrance end to a discharge end for the sheets;
b) discharging sheets from the discharge end of the first conveyor onto a first stacking platform, while gradually lowering the first stacking platform moving it away from the discharge end of the first conveyor and keeping the discharge end of the first conveyor in a position where the sheets are delivered to the first stacking platform, and forming a stack of sheets on the first stacking platform;
c) forming a first gap in the flow of sheets along the first conveyor;
d) when the first gap in the flow of sheets achieves the discharge end of the first conveyor, aligning the discharge end of the first conveyor with an entrance end of a second conveyor;
e) conveying a flow of shingled sheets sequentially along the first conveyor and the second conveyor, that are aligned with each other, and discharging the sheets from a discharge end of the second conveyor onto a second stacking platform, while gradually lowering the second stacking platform moving it away from the discharge end of the second conveyor;
f) forming a second gap in the flow of sheets along the first conveyor;
g) when the second gap in the flow of sheets achieves the discharge end of the first conveyor, moving the discharge end of the first conveyor into a position where the sheets are delivered to the first stacking platform;
h) conveying the flow of shingled sheets along the first conveyor and discharging the sheets from the discharge end of the first conveyor onto the first stacking platform, while gradually lowering the first stacking platform moving it away from the discharge end of the first conveyor.

Further embodiments and characteristics of methods according to the present invention will be described below and in the attached claims.

BRIEF DESCRIPTION OF THE DRAWING

The invention will be better understood by following the description below and the attached drawing, showing a non-limiting embodiment of the invention. More specifically, in the drawing.

DETAILED DESCRIPTION

Figure 1:
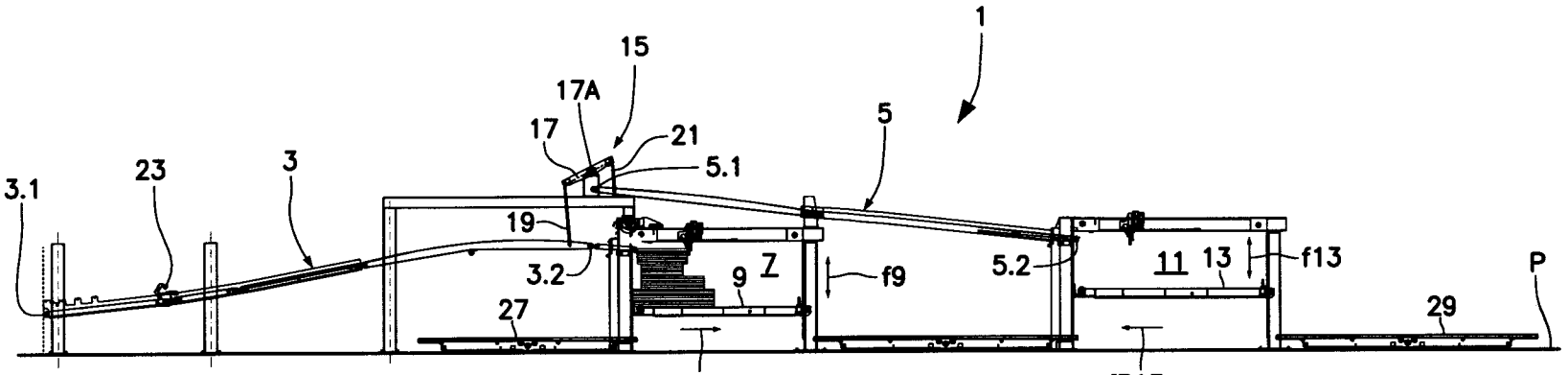
FIG. 1 is a side view of a stacker in an embodiment and in a first working position.
Figure 2:
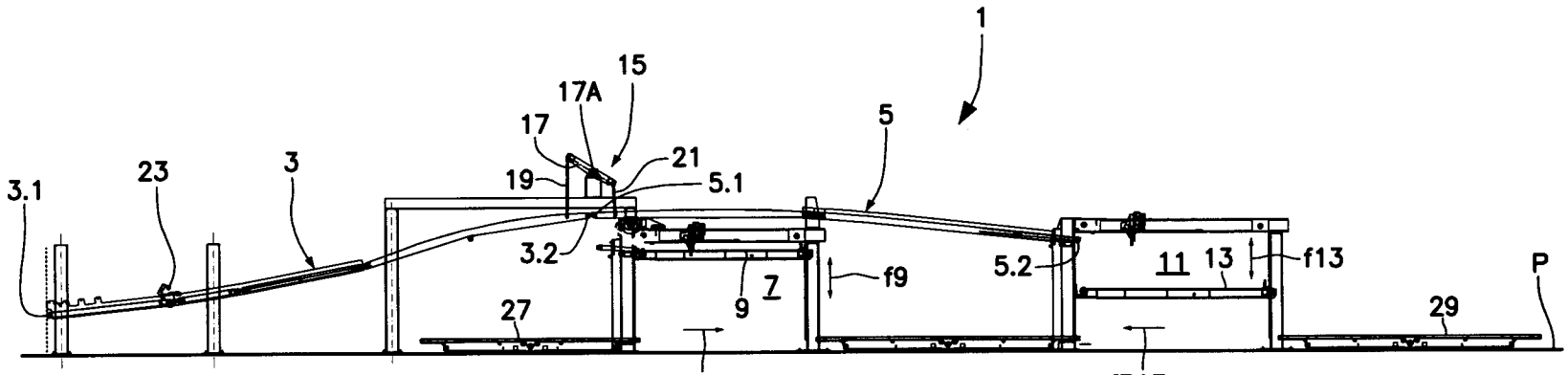
FIG. 2 is a side view of the stacker of FIG. 1 in a different working position.

Referring first to FIGS. 1 and 2, a stacker according to the present invention is indicated as a whole with the reference number 1. The stacker 1 comprises a first conveyor 3 having an entrance end 3.1 and a discharge end 3.2 for corrugated board sheets. In general, the conveyor 3 can comprise a series of conveyor belts arranged in sequence. The stacker 1 also comprises a second conveyor 5 having an entrance end 5.1 and a discharge end 5.2 for corrugated board sheets. Also the second conveyor 3 can comprise a series of conveyor belts arranged in sequence.

The discharge end 3.2 of the first conveyor 3 is associated with a first stacking bay 7, where a first stacking platform 9 is arranged. The first stacking platform 9 is provided with a movement in vertical direction according to the double arrow 19, to form stacks of corrugated board sheets coming from the first conveyor 3, as detailed below.

The discharge end 5.2 of the second conveyor 5 is associated with a second stacking bay 11, where a second stacking platform 13 is arranged. The second stacking platform 13 is provided with a movement in vertical direction according to the double arrow f13, to form stacks of corrugated board sheets coming from the second conveyor 5, as detailed below.

As can be clearly understood by comparing FIGS. 1 and 2, the first conveyor 3 and the second conveyor 5 are movable into two distinct positions. In a first position, shown in FIG. 1, the discharge end 3.2 of the first conveyor 3 is misaligned relative to the entrance end 5.1 of the second conveyor 5. In this position, corrugated board sheets fed along the first conveyor 3 are discharged onto the first stacking platform 9 and form a stack on it. The second conveyor 5 is disabled and the second stacking platform 13 can perform an evacuation cycle for evacuating a stack of sheets previously formed on the second stacking platform 13, as described below with reference to the sequence of FIGS. 3A-3D.

FIG. 2 shows the second position that the first conveyor 3 and the second conveyor 5 can take. In this second position, the discharge end 3.2 of the first conveyor 3 is aligned with the entrance end 5.1 of the second conveyor 5. In practice, in this position, the first conveyor 3 and the second conveyor 5 form a single conveying path for conveying the corrugated board sheets towards the second stacking bay 11, to stack the sheets on the second stacking platform 13.

To move the first conveyor 3 and the second conveyor 5 to one or the other of the two positions, a switching device 15 is provided. In the illustrated embodiment, the switching device 15 includes a rocker 17 pivoting around a horizontal axis 17A transversal to the feed direction of the first conveyor 3 and the second conveyor 5. The axis 17A is in an intermediate position of the rocker 17, which therefore has two opposite ends with respect to the axis 17A. The first end of the rocker 17 is connected, for example through a rod 19, to the first conveyor 3 near the discharge end 3.2 thereof, while the second end of the rocker 17 is connected through a rod 21 to the second conveyor 5, near the entrance end 5.1 thereof. The two alternative positions of the first conveyor 3 and the second conveyor 5 are achieved by pivoting the rocker 17. This pivoting movement can be controlled by an appropriate actuator, not shown, for example an electric motor, a linear cylinder-piston actuator, a jack or the like.

The corrugated board sheets are fed to the entrance end 3.1 of the first conveyor 3 in shingled arrangement, i.e. partially overlapped with each other, as schematically shown in the enlargement of FIG. 1C.

A device 23 is associated with the first conveyor 3, configured to generate a gap in the flow of corrugated board sheets fed along the first conveyor 3. The device 23 can be configured for example as described in EP557255, or in any other known manner. In practice, the device 23 is used to stop the normally continuous flow of partially superimposed (shingled) corrugated board sheets F, which move forward along the first conveyor 3, to allow a temporary gap in the flow of sheets moving towards the stacking platforms and to allow the switching from one to the other of the two positions of the first conveyor 3 and the second conveyor 5, without said switching disturbing the flow of corrugated board sheets to be stacked. A gap I in the flow of corrugated board sheets F is shown, just by way of example, in FIG. 1C, where the device 23 has been omitted for the sake of clarity of representation.

Figure 1A:
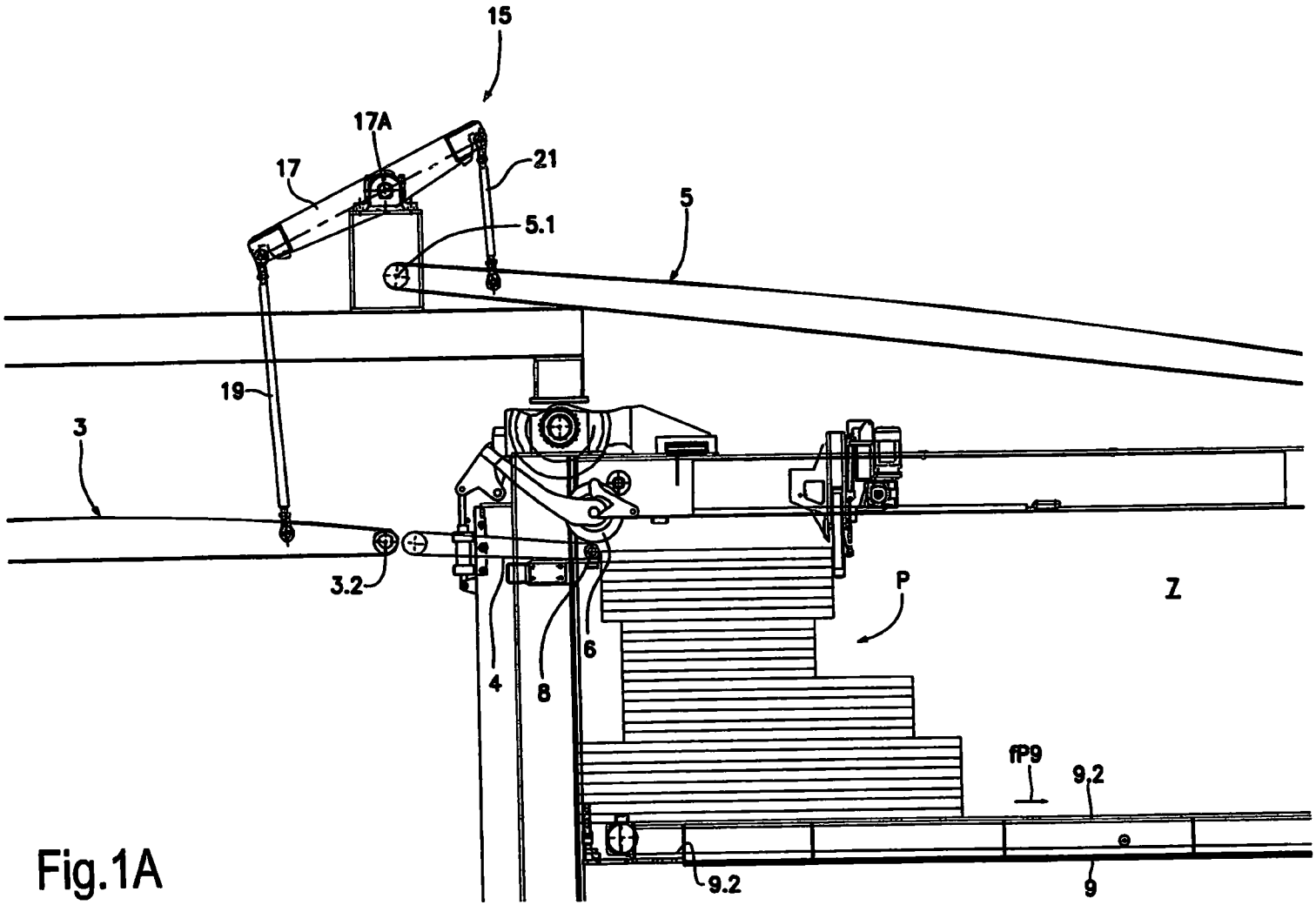
FIG. 1A is an enlargement of a portion of FIG. 1.
Figure 1B:
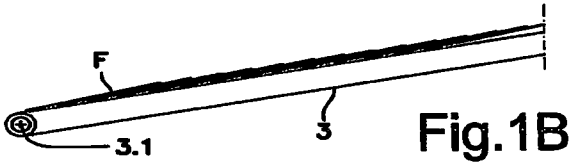
FIG. 1B is an enlargement of the entrance area of a first conveyor, where the shingled corrugated board sheets fed onto the conveyor are schematically indicated.

The enlargement in FIG. 1A shows more details of the discharge area where the corrugated board sheets are discharged, through the first conveyor 3, onto the first stacking platform 9 arranged in the first stacking bay 7. For reasons that will be better explained below, the discharge end 3.2 of the first conveyor 3 does not directly discharge the sheets F onto the stack being formed on the first stacking platform 9, but it discharges them onto an auxiliary conveyor 4 supported in substantially stationary position with respect to the first stacking bay 7. In this context, when referred to the auxiliary conveyor 4, "substantially stationary" means that the conveyor is not moved upwards and downwards by the switching device 15, following the motion of the first conveyor 3, but it remains at a constant height.

First rollers are associated with the first auxiliary conveyor 4 for controlling the discharge of the sheets onto the first stacking platform 9. The rollers for controlling the discharge of the sheets F are indicated with the reference numbers 6 and 8 in FIG. 1A. Also the rollers 6 and 8 for controlling the discharge of the sheets F are substantially stationary relative to the stacking bay.

Figure 2A:
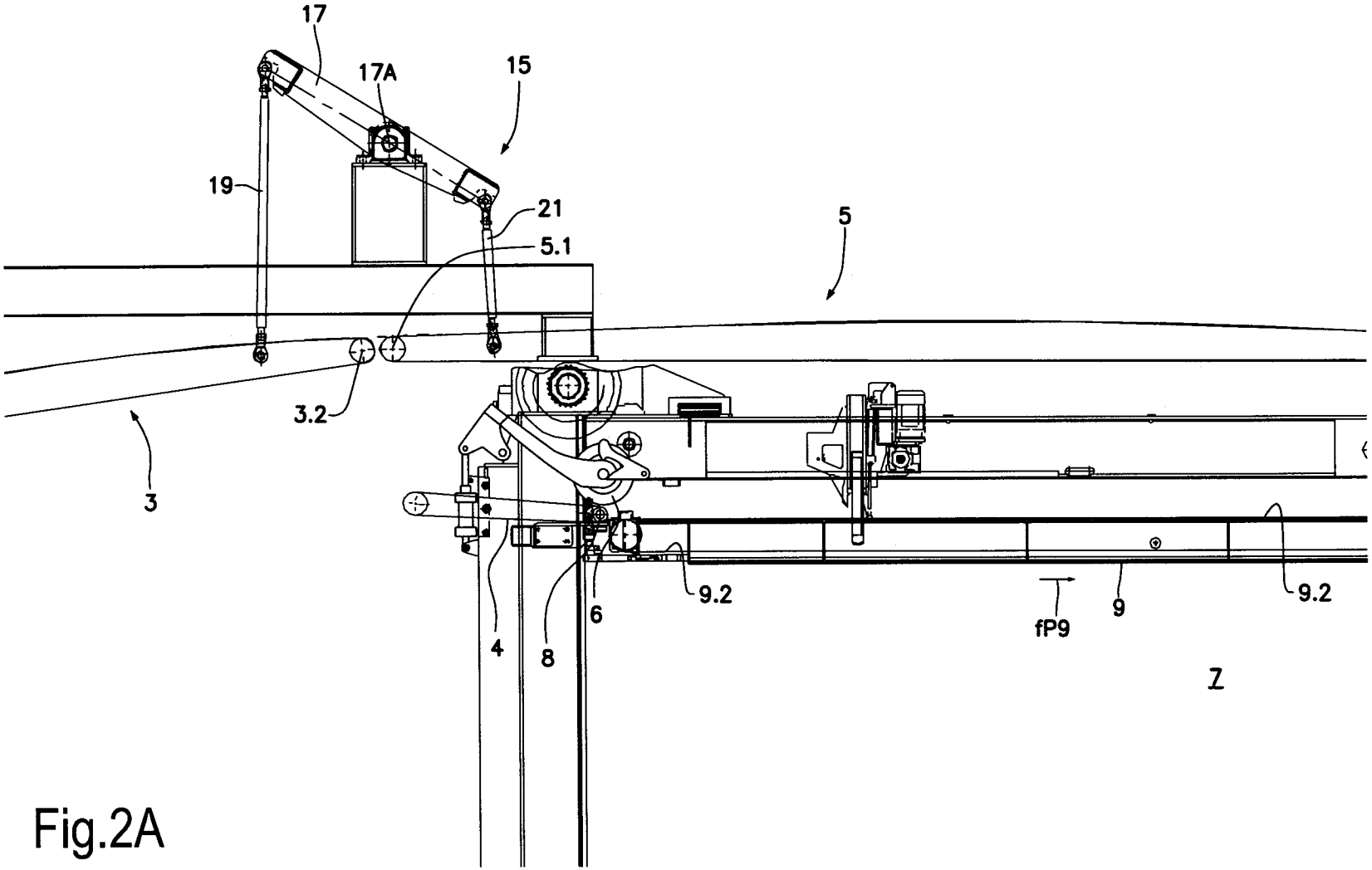
FIG. 2A is an enlargement of a portion of FIG. 2.

FIG. 2A shows an enlargement like that of FIG. 1A, but with the first conveyor 3 aligned with the second conveyor 5, to feed a flow of sheets F to the second stacking platform 13 (arrangement of FIG. 2). As can be understood by comparing FIGS. 1A and 2A, since the auxiliary conveyor 4 and the control rollers 6, 8 for controlling the discharge of the sheets F remain in a substantially fixed position when the conveyor 3 is lifted to align the discharge end 3.2 with the entrance end 5.1, the switching device can have an extremely simple shape. In addition, the weight of the members to be moved is reduced and therefore the movement from the position of FIG. 1A to the position of FIG. 2A and vice versa can be very quick.

FIG. 2A shows rollers for controlling the discharge of the sheets F onto the second stacking platform 9, similar to the rollers 6, 8 associated with the auxiliary conveyor 4. In this case, the discharge control rollers are arranged at the discharge end 5.2 of the second conveyor 5.

In the embodiment of FIGS. 1 and 2, the stacker 1 comprises an evacuation platform 25 arranged between the first stacking bay 7 and the second stacking bay 11. The evacuation platform 25 can be placed at a fixed height, for example at the level of a floor P. The evacuation platform 25 is arranged so as to receive stacks of corrugated board sheets from the first stacking platform 9 and from the second stacking platform 13. For this purpose, the first stacking platform 9 can be arranged in a lower position (position 9X in FIGS. 1A, 2), where the upper surface thereof, on which the stack of corrugated board sheets rests, is nearly coplanar with the upper surface of the evacuation platform 25. The first stacking platform 9 can be provided with a conveyor, for example a belt conveyor or a roller conveyor, adapted to translate the stack of corrugated board sheets formed on the first stacking platform 9 in the direction indicated by the arrow fp9 in FIGS. 1A and 2, to transfer the stack onto the evacuation platform 25 when the first stacking platform 9 is aligned (position 9X in FIGS. 1*a* and 2) with the evacuation platform 25.

Similarly, to evacuate the stacks of corrugated board sheets from the second stacking platform 13, this latter can be arranged in a lower position (position 13X in FIG. 2), where the upper surface of the second stacking platform 13, on which the stack of corrugated board sheets rests, is approximately coplanar with the upper surface of the evacuation platform 25. The second stacking platform 13 can be provided with a conveyor, for example a belt conveyor or a roller conveyor, adapted to translate the stack of corrugated board sheets formed on the second stacking platform 13 in the direction indicated by the arrow fp13 in FIG. 2, to transfer the stack onto the evacuation platform 25 when the second stacking platform 13 is aligned (position 13X in FIG. 2) with the evacuation platform 25.

The evacuation platform 25 can be provided with conveying members, for example belt and/or roller conveying members, which move the stacks of corrugated board sheets in a direction parallel to the directions fp9 and fp13, or in a horizontal direction orthogonal to fp9 and fp13. In this way, each stack of corrugated board sheets transferred onto the evacuation platform 25 can be centered on the evacuation platform and subsequently removed with a movement orthogonal to the plane of FIGS. 1, 1A, 2, to be transferred, for example, onto a transfer line, not shown, towards a packaging area.

In addition or as an alternative to the evacuation platform 25, the stacker 1 can comprise a second evacuation platform 27 arranged under the first conveyor 3 and/or a third evacuation platform 29, adjacent to the second stacking bay 11 on the side opposite to the direction from which the corrugated board sheets are fed, i.e. on the opposite side with respect to the side facing the first stacking bay 7. The second evacuation platform 27 can be used, as an alternative to the evacuation platform 25, to receive stacks formed on the first stacking platform 9. Similarly, the third evacuation platform 29 can be used, as an alternative to the evacuation platform 25, to receive stacks formed on the second stacking platform 13.

The stacker 1 described above allows to substantially reduce the slowdown of the production line due to the evacuation of the individual stacks of corrugated board sheets that are formed on the first stacking platform 9 and on the second stacking platform 13.

The sequence of FIGS. 3A, 3B, 3C, 3D, 3E shows an operating cycle of the stacker 1, to better understand the operation and the advantages thereof.

Figure 3A:
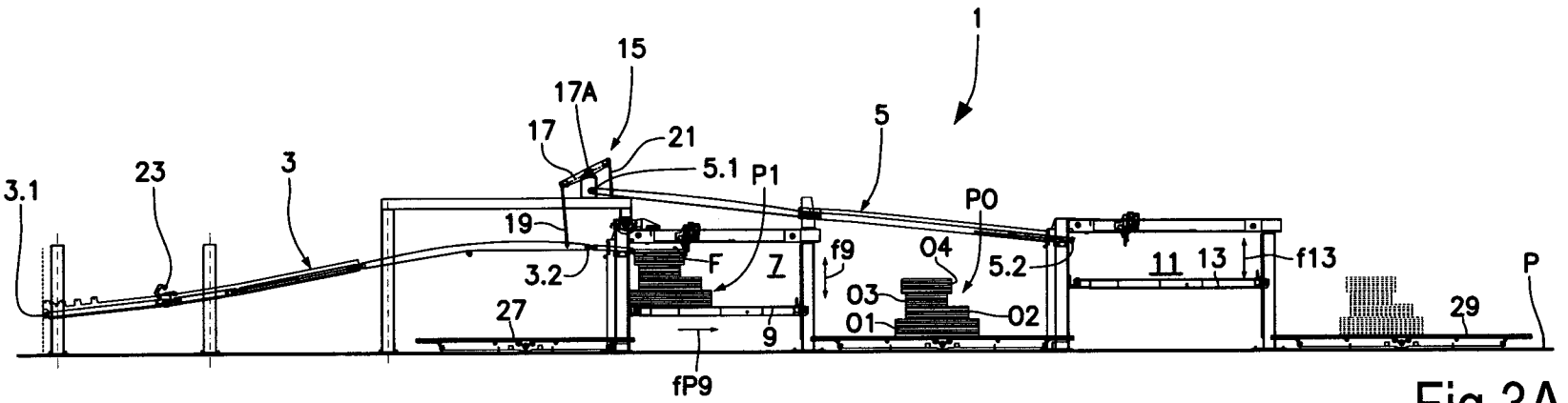
FIGS. 3A-3E show an operating sequence of the stacker of FIGS. 1 and 2.

FIG. 3A shows a step of the operating cycle, in which the first conveyor 3 and the second conveyor 5 are in the first position. The first conveyor 3 feeds corrugated board sheets F onto the first stacking platform 9 and forms a first stack P1. To this end, the first stacking platform 9 gradually lowers as the stack P1 increases in height. As schematically shown in FIG. 3A, the stack P1 can be comprised of groups of corrugated board sheets F of different shapes and sizes. Each group (consisting of corrugated board sheets F equal to one other) constitutes an order. The individual orders are stacked in a single stack if this is allowed by the size of the sheets of the various orders. In this way, more orders of small size can be grouped on a single stack before evacuating the stack.

By way of example, FIG. 3A shows how, during the formation of the first stack P1 of corrugated board sheets on the first stacking platform 9, a stack P0 previously formed on the second stacking platform 13 has been evacuated onto the evacuation platform 25, so that the second evacuation platform 13 can be moved upwards to achieve the position of formation of a new stack of corrugated board sheets when the stack P1 has been completed.

Figure 3B:
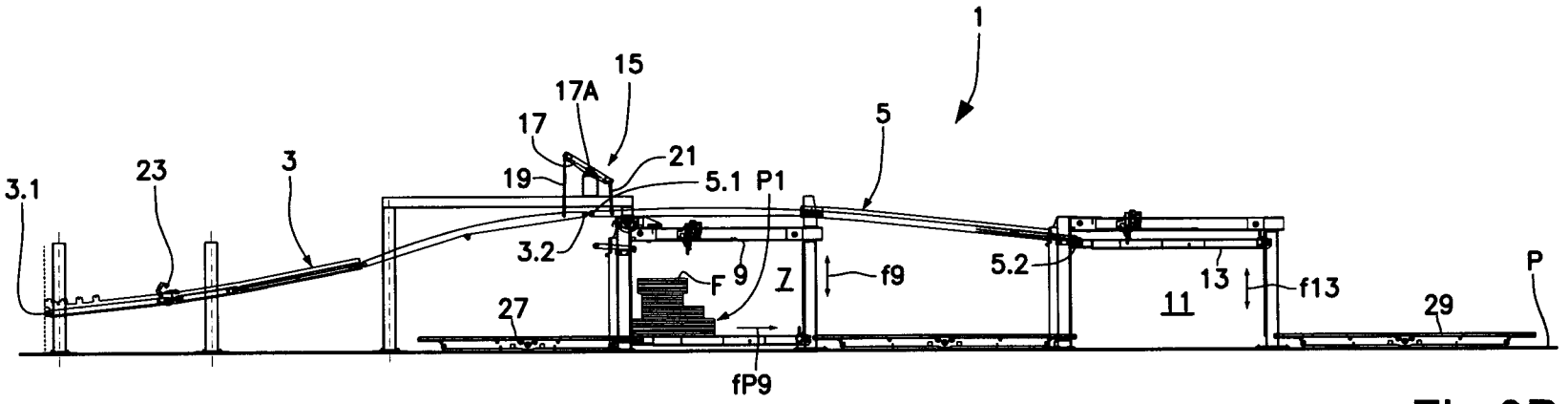

In FIG. 3B, the stack P0 has been evacuated and the first stack P1 has been completed. The first stacking platform 9 is in the lower position, aligned with the evacuation platform 25. The second stacking platform 13 is in upper position to start the formation of a second stack of corrugated board sheets.

The switching device 23 has switched the mutual position of the first conveyor 3 and the second conveyor 5, bringing the discharge end 3.2 of the first conveyor in alignment with the entrance end 5.1 of the second conveyor 5. This operation is performed when the last corrugated board sheet F, which must be discharged onto the stack P1, has left the first conveyor 3 and the gap I in the flow of corrugated board sheets, moving forwards along the first conveyor 3, has reached the discharge end 3.2 of the first conveyor.

In this way, the switching of the mutual position of the first conveyor 3 and the second conveyor 5 takes place without disturbing the flow of the sheets.

Since the switching from the first position (FIG. 1, FIG. 3A) to the second position (FIG. 2, FIG. 3B) of the first conveyor 3 and of the second conveyor 5 takes place in a very short time, the gap I in the flow of corrugated board sheets F can be very small, so as to affect the average speed of the stacker only in a limited way.

In the arrangement of FIG. 3B, the stacker 1 can perform the following operations: evacuating the first stack P1 from the first stacking platform 9 onto the evacuation platform 25; start feeding corrugated board sheets F along the first conveyor 3 and the second conveyor 5 to start the formation of a second stack P2 of corrugated board sheets F on the second stacking platform 13.

Figure 3C:
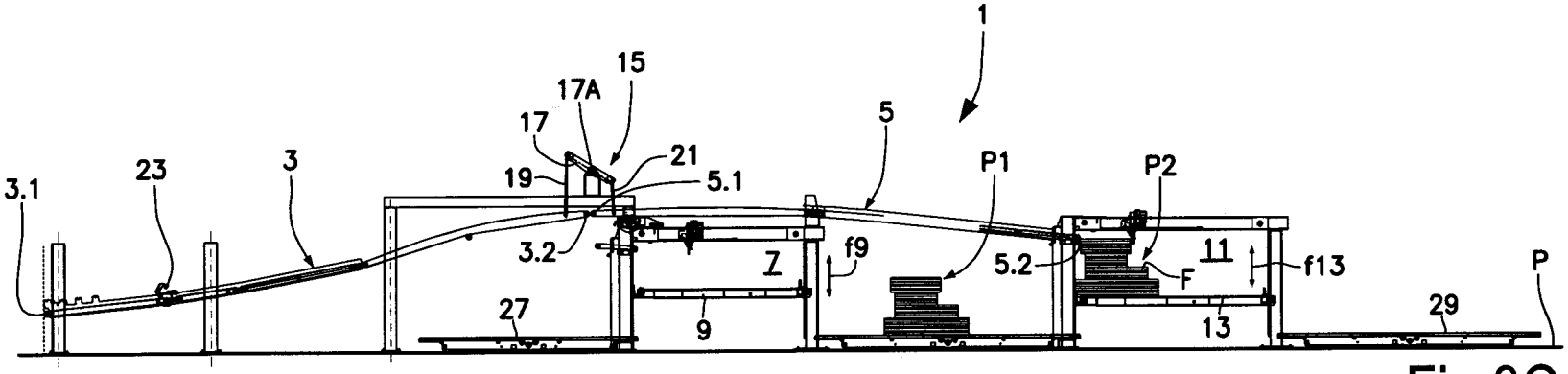

FIG. 3C shows the following step, where a second stack P2 of corrugated board sheets F is forming on the second stacking platform 13, while the first stack P1 of corrugated board sheets has been transferred from the first stacking platform 9 to the evacuation platform 25. The first stacking platform 9 is translating upwards to achieve the position where the formation of a third stack of corrugated board sheets will begin.

Figure 3D:
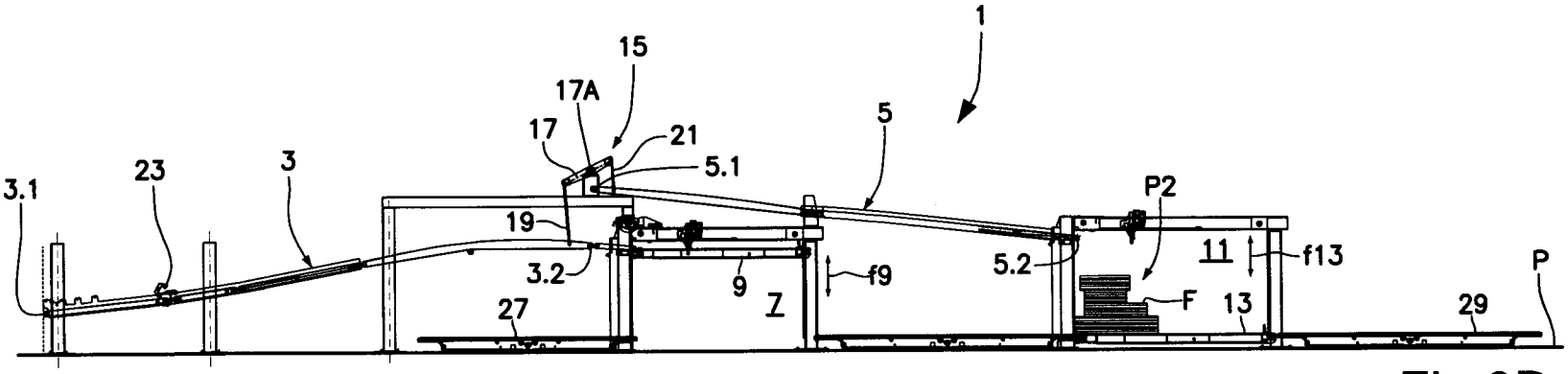

In FIG. 3D, the second stacking platform 13 is at the height of the evacuation platform 25 and the second stack P2 can be evacuated (arrow fp13) towards the evacuation platform 25. The first evacuation platform 9 is at the height of the discharge end 3.2 of the first conveyor 3, which has been brought by the switching device 15 back to the first position, corresponding to the position of FIG. 3A.

Figure 3E:
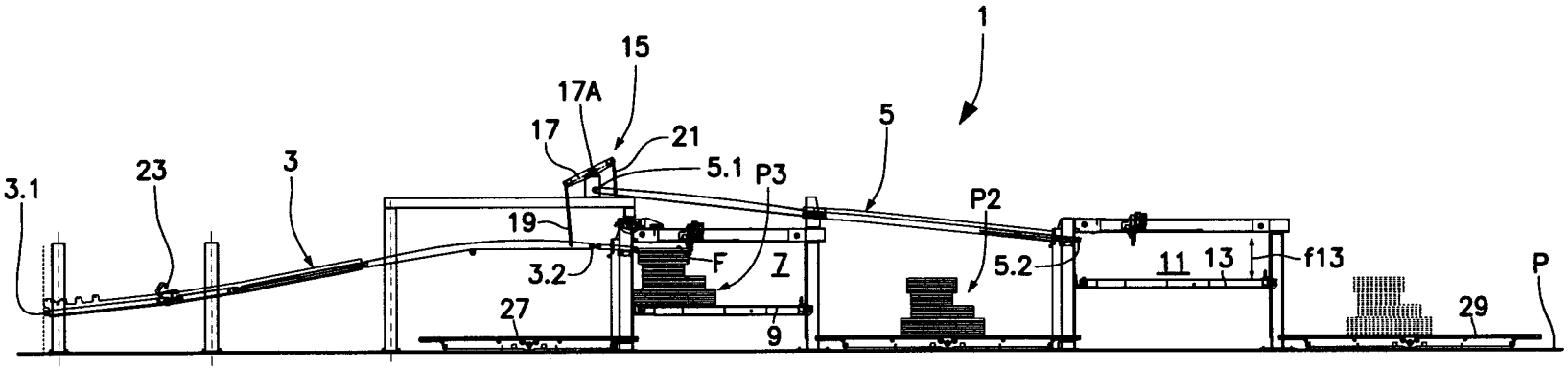

In the following step, shown in FIG. 3E and corresponding to the step of FIG. 3A, a third stack P3 of corrugated board sheets is formed on the first stacking platform 9, while the second stack P2 of corrugated board sheets has been transferred to the evacuation platform.

Briefly, in this operating mode the stacker performs a method comprising the following steps:

a) conveying a flow of shingled sheets along the first conveyor;

b) discharging sheets from the discharge end of the first conveyor onto the first stacking platform, while gradually moving the first stacking platform away from the discharge end of the first conveyor, and forming a stack of sheets on the first stacking platform;

c) forming a first gap in the flow of sheets along the first conveyor;

d) when the first stack of sheets has been completed and the first gap in the flow of sheets achieves the discharge end of the first conveyor, aligning the discharge end of the first conveyor with the entrance end of the second conveyor;

e) conveying a flow of shingled sheets sequentially along the first conveyor and the second conveyor, that are aligned with each other, and discharging the sheets from the discharge end of the second conveyor onto the second stacking platform, while gradually moving the second stacking platform away from the discharge end of the second conveyor, and forming a second stack of sheets on the second stacking platform;

f) whilst the sheets move forward along the first conveyor and the second conveyor towards the second stacking platform, evacuating the first stack of sheets from the first stacking platform and then bringing the first stacking platform from an evacuation position again to a stacking position.

g) forming a second gap in the flow of sheets along the first conveyor;

h) when the second stack of sheets has been completed and the second gap in the flow of sheets achieves the discharge end of the first conveyor, moving the discharge end of the first conveyor into a position where the sheets are supplied to the first stacking platform;

i) discharging sheets from the discharge end of the first conveyor onto the first stacking platform, while gradually moving the first stacking platform away from the discharge end of the first conveyor, and forming a third stack of sheets on the first stacking platform;

j) whilst the sheets move forward along the first conveyor toward the first stacking platform to form the third stack of sheets, evacuating the second stack of sheets from the second stacking platform and bringing the second stacking platform from an evacuation position to a stacking position again.

While the sequence of FIGS. 3A-3E shows a situation where the stacks P0, P1, P2, P3 of corrugated board sheets F are evacuated through the evacuation platform 25 arranged in an intermediate position between the two stacking bays 7 and 11, in other embodiments the evacuation platforms 27 and/or 29 may be used instead of the evacuation platform 25.

If the evacuation platform 25 is always used, the evacuation platforms 27 and 29 can be omitted. In other embodiments, the pair of evacuation platforms 25, 27 or the pair of evacuation platforms 25, 29 may be provided.

The use of a single evacuation platform 25 arranged in an intermediate position between the two stacking bays has the advantage of simplifying the plant layout, for example because it is possible to use a single transfer path for the stacks of sheets formed on the two stacking platforms.

Figure 4:
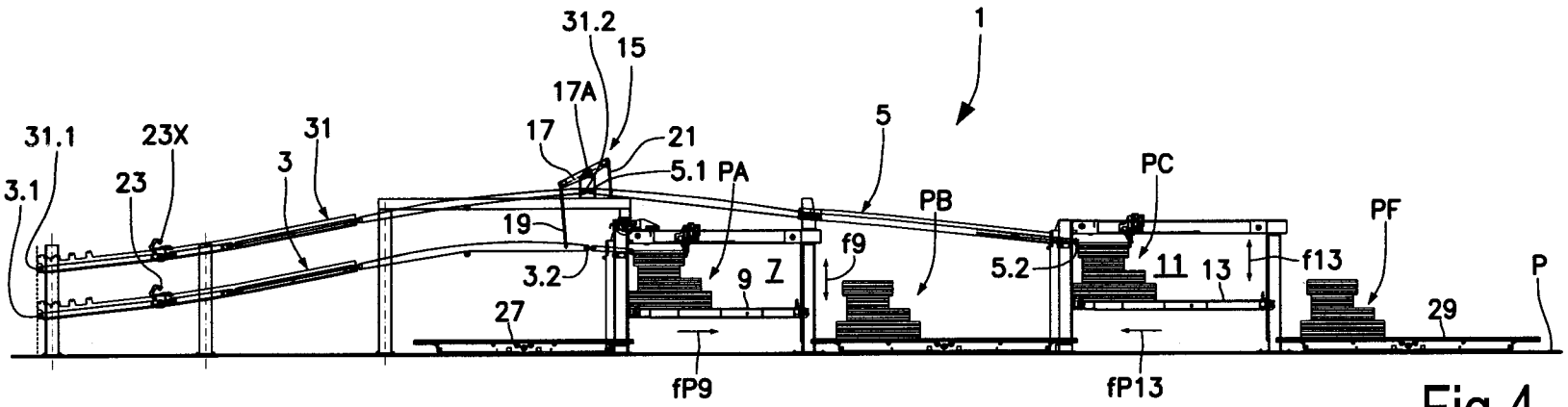
FIG. 4 is a side view of a stacker in a further embodiment and in a first working position.
Figure 5:
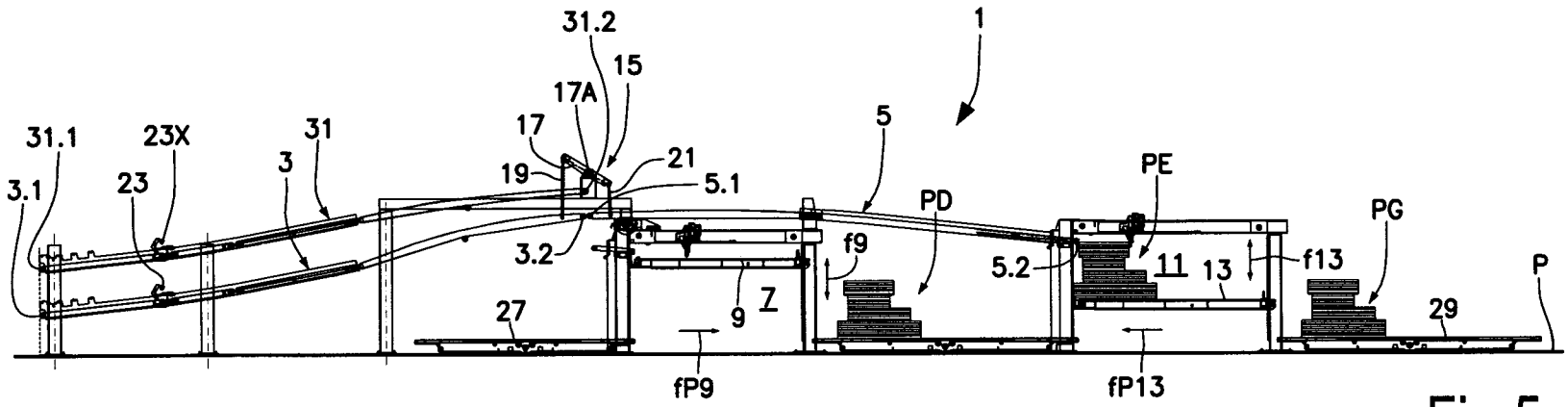
FIG. 5 is a side view of the stacker of FIG. 4 in a different working position.

The stacker of the present invention can be modified in various ways, to increase the flexibility of use. For example, FIGS. 4 and 5 show an embodiment of a stacker, indicated again with the reference number 1, where a third conveyor is provided to simultaneously form two stacks of corrugated board sheets on the two stacking platforms at the same time. Equal numbers in FIGS. 4 and 5 indicate the same elements already described with reference to FIGS. 1-2, which therefore will be not described again.

In FIG. 4, the stacker 1 is in the position of FIG. 1 and in FIG. 5 it is in the position of FIG. 2. The reference number 31 indicates a third conveyor, which comprises an entrance end 31.1 and a discharge end 31.2 for the corrugated board sheets. The third conveyor 31 is stationary, while the first conveyor 3 and the second conveyor 5 are connected to the switching device 17, which performs the same function already described above.

In the position of FIG. 4, the conveyor 3 can be used as described above, to form a stack PA of corrugated board sheets F on the first stacking platform 9, whilst the second conveyor 5 and the third conveyor remain inactive. In the position of FIG. 5, the first conveyor 3 and the second conveyor 5 are aligned with each other and feed corrugated board sheets F to the second stacking bay 11 to form a stack PE of corrugated board sheets on the second stacking platform 13.

In this case, the stacker 1 is used as already described with reference to the sequence of FIGS. 3A-3E.

Alternatively, the stacker 1 can be used by keeping it in the position of FIG. 4, simultaneously forming stacks PC of corrugated board sheets F on the second stacking platform 13 in the second stacking bay 11, and stacks PA of corrugated board sheets F on the first stacking platform 11 in the first stacking bay 7. The sheets forming the stacks PA are fed by the first conveyor 3, while the sheets forming the stacks PC are fed by the sequence of the third conveyor 31 and the second conveyor 5.

The stacks formed on the first stacking platform 9 and on the second stacking platform 13 can be evacuated using for example two evacuation platforms. In the example of FIG. 4, PB indicates a stack (for example formed on the first stacking platform 9) evacuated through the evacuation platform 25, and PF indicates a stack evacuated from the second stacking platform 13 through the third evacuation platform 29. In other embodiments, the stacks formed by the first stacking platform 9 can be evacuated onto the second evacuation platform 27 and the stacks formed on the second stacking platform 13 can be evacuated onto the evacuation platform 25 and/or the third evacuation platform 29.

As can be seen just by way of example in FIGS. 3A-3E, each stack P0, P1, P2 . . . is formed by a plurality of groups of sheets, wherein the longitudinal dimension of the sheets of one group is different from the longitudinal dimension of the sheets of an adjacent group in the same stack. "Longitudinal dimension" means the dimension in the direction approximately parallel to the feeding direction of the sheets to the stacking platforms 9, 13. It is understood that also the direction orthogonal to the longitudinal one can vary from one group of sheets to another. Each group of identical sheets constitutes a work order. In FIG. 3A, three processing orders O1, O2, O3, O4 are indicated in the stack P0 by way of example.

In the illustrated example, the work orders are very short, and therefore a plurality of different orders are put over one another in the same stack.

When different orders are stacked on the same stack, there are limits and constraints in the mutual arrangement of the single orders. In fact, by putting over one another groups of sheets having different dimensions, a lack of balance between groups of sheets can occur. For example, it is not possible to put a group of very long sheets over a group of very short sheets. Furthermore, to increase the stability of the stack formed by several consecutive orders, it is advisable that a shorter order is placed in an intermediate position of an adjacent longer order. For example, with reference to FIG. 3A and to the stack P0, the second order O2 is shorter (that is, the sheets thereof have a smaller longitudinal dimension) than the previous order O1. The O2 order is arranged in an intermediate position, approximately central, with respect to the order O1. The same occurs for the subsequent orders, up to the order O4 that, having longitudinal dimension greater than the previous order O3, is arranged, with respect to this latter, in such a way that the order O3 is placed in an intermediate, approximately central (in the longitudinal direction) position with respect to the order O4.

For centering, or in general positioning, each order Oi with respect to the previous order O(i−1), it can be provided that the first stacking platform 9 comprises a first stacking conveyor 9.2 provided with a movement (fp9) in a longitudinal direction approximately parallel to the feed direction for feeding the sheets from the first conveyor 3 to the first stacking platform 9;

the second stacking platform 11 comprises a second stacking conveyor 11.2 provided with a movement in a longitudinal direction (fo11) approximately parallel to the feed direction for feeding the sheets from the second conveyor to the second stacking platform; and the first stacking conveyor 9.2 and the second stacking conveyor 11.2 are controlled so as to move a stack of sheets being formed in a direction parallel to the longitudinal direction, so as to put orders of sheets of different format over one another in such mutual position that orders formed by sheets of shorter longitudinal dimension are arranged in intermediate position relative to adjacent orders formed by sheets of longer longitudinal dimension.

In some cases, the differences in length (dimension in the longitudinal direction) of the sheets of two orders is such as not to allow them to be put over one another. In this case, it is necessary to interrupt the formation of the stack with the previous order, to evacuate it, and to start the formation of a new stack with the following order, which cannot be stacked on the previous order. All this leads to a loss of productivity.

The stacker described herein allows to overcome or alleviate this problem, because, when two orders (a previous order and a subsequent order) cannot be stacked directly over each other in one of the stacking bays, it is possible to divert the subsequent order into the other stacking bay, without evacuating the stack on which the previous order has been stacked. When, in the sequence of orders to be produced, there is an order that, thanks to its longitudinal dimension, can be stacked on the previous order, the arrangement of the conveyors is switched and this order is stacked on the previous order.

Figure 6A:
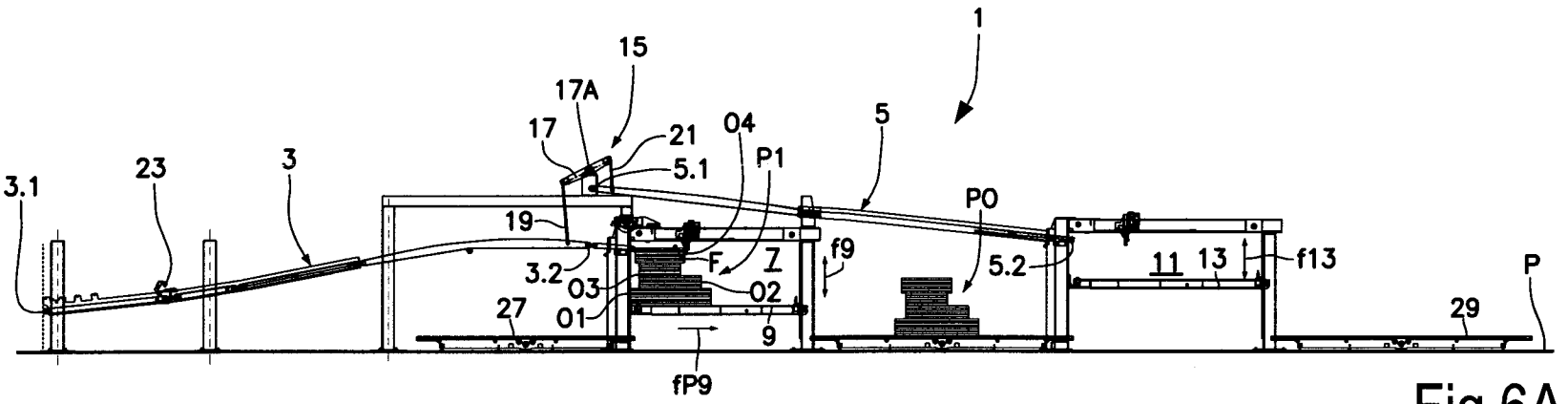
FIGS. 6A-6D show an operating sequence similar to the sequence of FIGS. 3A-3E, in a different operation mode.

FIGS. 6A, 6B, 6C, and 6D show a sequence of this type. In FIG. 6A a stack P0 is on the evacuation platform 25 and a stack P1 is in the stacking bay on the first stacking platform 9, which is gradually lowering to move away from the discharge end 3.2 and from the auxiliary conveyor 4, whilst the stack P1 increases in height. In FIG. 6A, four orders O1, O2, O3, O4 formed on the stack P1 are shown.

Figure 6B:
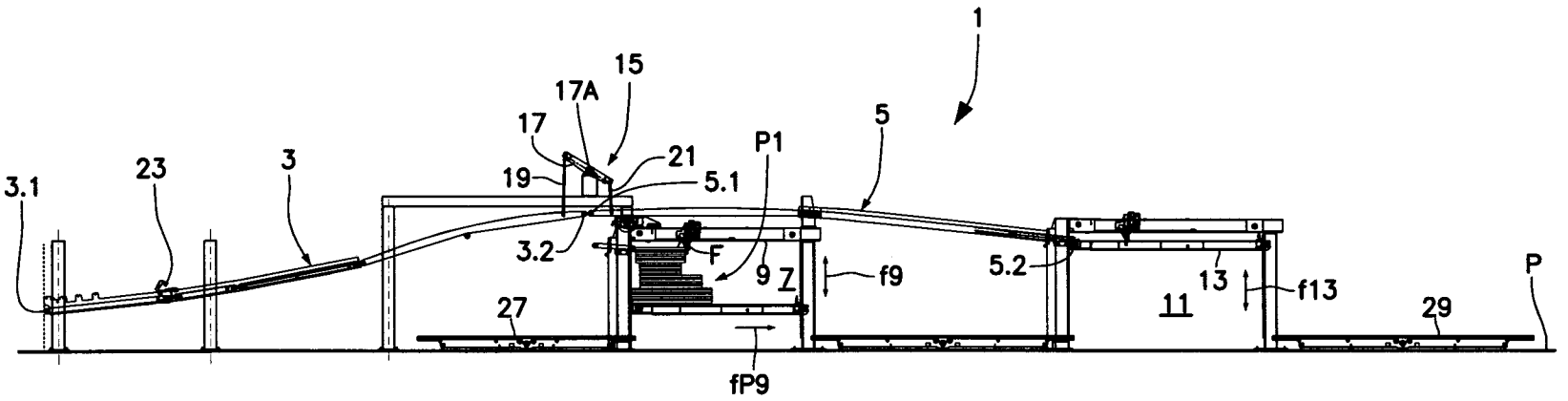

Assuming that the subsequent order O5 has such longitudinal dimensions (i.e. in the feed direction of the sheets F) that it cannot be stacked over the order O4, the stacker switches to the position of FIG. 6B. In this example, the second stacking platform 13 is empty, as the stack P0 has previously been evacuated. In other production cycles, in this step a partially formed stack can be present on the second stacking platform 9.

Figure 6C:
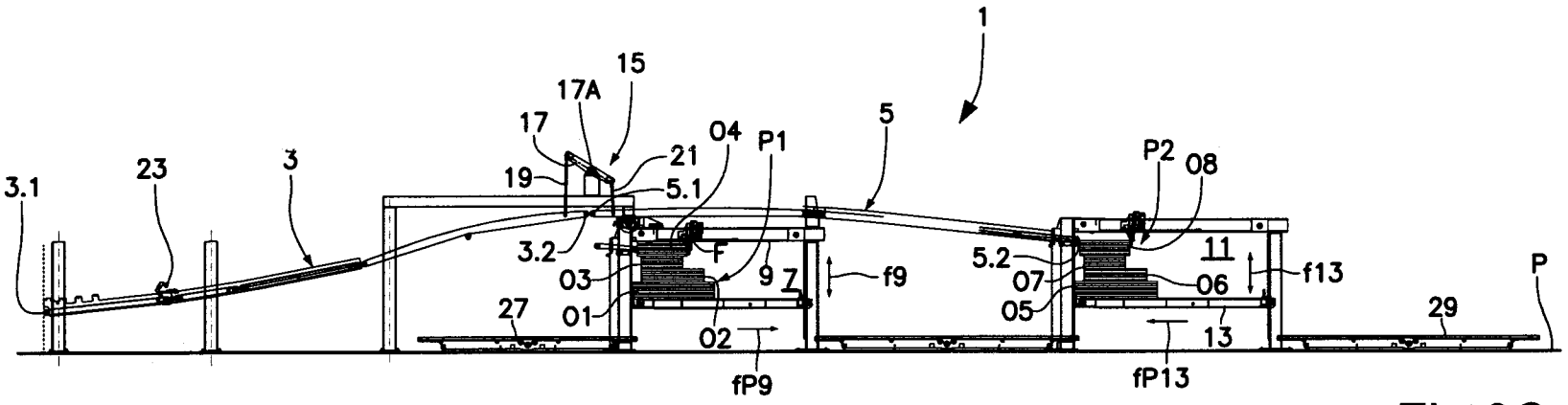

As can be seen in FIG. 6C, the order O5 is formed on the second stacking platform 9. However, contrary to the sequence of FIGS. 3A-3E, in this operating cycle the stack P1 has not been evacuated from the first stacking platform 9, but remains there, waiting.

FIG. 6C actually shows a step subsequent to that of formation of the order O5. In fact, on the second stacking platform 13 there is already a stack P2 of orders O5, O6, O7, O8 put over one another.

Figure 6D:
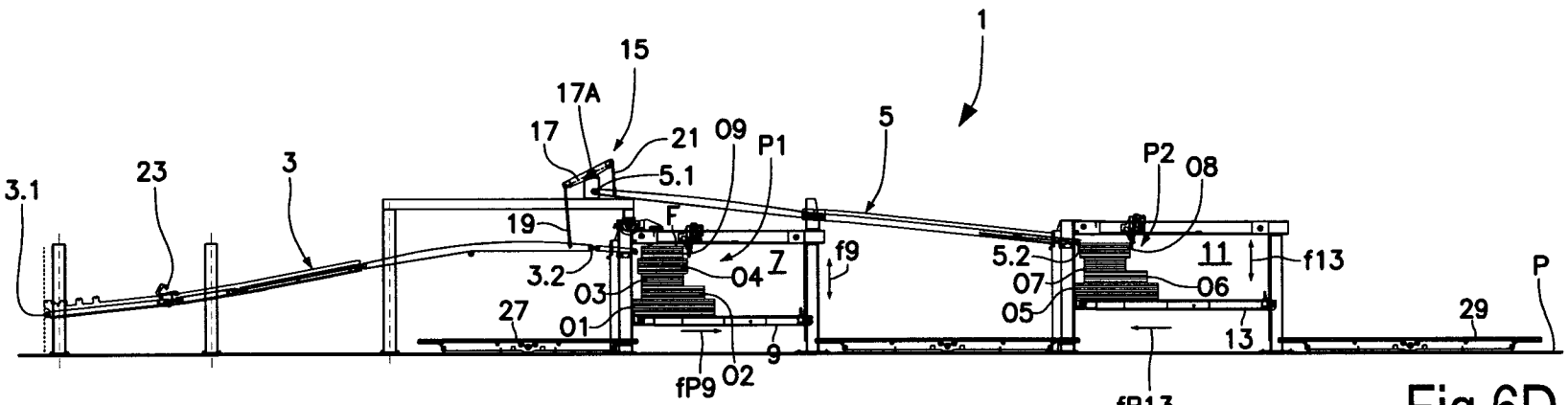

Assuming now that the order O9, following the order O8, cannot be stacked over the order O8 for reasons of stability of the stack formed, the stacker switches to the position of FIG. 6D (corresponding to the position of FIG. 6A). In this position, the order O9 is formed on the stack P1.

In this exemplary cycle, the stack P2 on the second stacking platform 13 has not been evacuated, as it is assumed that there is a subsequent order that shall be stacked in a later step on the stack P2. In other operating cycles, the stack P2 may be complete, and, in this case, it will be evacuated before the stacker switches back to the position of FIG. 6B.

Essentially, every time a gap I is formed in the flow of shingled sheets F that move forward along the conveyors 3, 5, the sheet discharge position switches from one to the other of the two stacking bays 7 and 11. The gap I is formed in the continuous flow of shingled sheets precisely for allowing to switch the position of the discharge end 3.2 of the first conveyor 3. However, the operations performed on the stack on which the sheets are no longer fed can be different:

A. if the stack has been completed when the conveyor 3 switches position, the stack is evacuated. For example, if the conveyor 3 switches from the position of FIG. 3A (or 6A) to the position of FIG. 3B (or 6B), the stack formed on the first stacking platform 9 is evacuated. If the conveyor 3 switches from the position of FIG. 3B (or 6B) to the position of FIG. 3A (or 6A), the stack formed on the first stacking platform 9 is evacuated;

B. if the stack has not been completed, and one or more orders scheduled in the production cycle must be accumulated on it, the stacking on the stack being formed is interrupted but the stack is not evacuated. For example, if the conveyor 3 switches from the position of FIG. 3A (or 6A) to the position of FIG. 3B (or 6B), the stack formed on the first stacking platform 9 remains on it and the stacking platform 9 remains in lifted position with respect to the evacuation position, so as to be ready, at a later step, to receive a new order. If the conveyor 3 switches from the position of FIG. 3B (or 6B) to the position of FIG. 3A (or 6A), the stack formed on the first stacking platform 11 remains on it and the stacking platform 11 remains in lifted position with respect to the evacuation position, waiting to receive the subsequent order.

What is claimed is:

1. A stacker for stacking sheets, including:

a first conveyor, comprising an entrance end and a discharge end for the sheets;

a first stacking platform, arranged to receive sheets discharged from the discharge end of the first conveyor;

wherein the first stacking platform is provided with a vertical lifting and lowering movement in a first stacking bay to allow forming stacks of sheets on the first stacking platform;

along the first conveyor, a device for interrupting a flow of shingled sheets moving forward along the first conveyor;

a second conveyor, comprising an entrance end and a discharge end for the sheets and arranged in series with the first conveyor;

a second stacking platform arranged to receive sheets discharged from the discharge end of the second conveyor;

wherein the second stacking platform is provided with a vertical lifting and lowering movement in a second stacking bay to allow forming stacks of sheets on the second stacking platform;

a switching device for arranging the discharge end of the first conveyor and the entrance end of the second conveyor selectively:

in a first position, where the discharge end of the first conveyor is misaligned relative to the entrance end of the second conveyor and positioned to discharge sheets from the first conveyor onto the first stacking platform; and a second position, where the discharge end of the first conveyor is aligned with the entrance end of the second conveyor to convey the sheets from the entrance of the first conveyor along the first and the second conveyors and to discharge the sheets onto the second stacking platform;

wherein the switching device comprises a rocker arm connected to the discharge end of the first conveyor and to the entrance end of the second conveyor.

2. The stacker of claim 1, wherein second control rollers are provided at the discharge end of the second conveyor for controlling the discharge of the sheets onto the second stacking platform.

3. The stacker of claim 1, further comprising an evacuation platform arranged in an intermediate position between the first stacking bay and the second stacking bay; wherein the evacuation platform is adapted to receive stacks of sheets from at least one of the first stacking platform and the second stacking platform.

4. The stacker of claim 1, further comprising an evacuation platform arranged below the first conveyor and adapted to receive stacks of sheets from the first stacking platform.

5. The stacker of claim 1, further comprising an evacuation platform, arranged on a side of the second stacking platform opposite the first stacking platform and adapted to receive stacks of sheets from the second stacking platform.

6. The stacker of claim 1, wherein:

the first stacking platform comprises a first stacking conveyor provided with a movement in a longitudinal direction approximately parallel to the feed direction for feeding the sheets from the first conveyor to the first stacking platform;

the second stacking platform comprises a second stacking conveyor provided with a movement in a longitudinal direction approximately parallel to the feed direction for feeding the sheets from the second conveyor to the second stacking platform; and the first stacking conveyor and the second stacking conveyor are controlled so as to move a stack of sheets being formed in a direction parallel to the longitudinal direction, so as to put orders of sheets of different format over one another in such mutual position that orders formed by sheets of shorter longitudinal dimension are arranged in intermediate position relative to adjacent orders formed by sheets of longer longitudinal dimension.

7. A stacker for stacking sheets, including:

a first conveyor, comprising an entrance end and a discharge end for the sheets;

a first stacking platform, arranged to receive sheets discharged from the discharge end of the first conveyor;

wherein the first stacking platform is provided with a vertical lifting and lowering movement in a first stacking bay to allow forming stacks of sheets on the first stacking platform;

along the first conveyor, a device for interrupting a flow of shingled sheets moving forward along the first conveyor;

a second conveyor, comprising an entrance end and a discharge end for the sheets and arranged in series with the first conveyor;

a second stacking platform arranged to receive sheets discharged from the discharge end of the second conveyor;

wherein the second stacking platform is provided with a vertical lifting and lowering movement in a second stacking bay to allow forming stacks of sheets on the second stacking platform;

a switching device for arranging the discharge end of the first conveyor and the entrance end of the second conveyor selectively:

in a first position, where the discharge end of the first conveyor is misaligned relative to the entrance end of the second conveyor and positioned to discharge sheets from the first conveyor onto the first stacking platform; and a second position, where the discharge end of the first conveyor is aligned with the entrance end of the second conveyor to convey the sheets from the entrance of the first conveyor along the first and the second conveyors and to discharge the sheets onto the second stacking platform;

wherein the stacker further comprises a third conveyor including an entrance end and a discharge end for the sheets; wherein the third conveyor is provided above the first conveyor and extends approximately parallel to the first conveyor; and wherein the switching device is configured so that, when the discharge end of the first conveyor and the entrance end of the second conveyor are in the second position, the first conveyor, the second conveyor and the third conveyor form:

a first path for conveying the sheets along the first conveyor, from the entrance end of the first conveyor to the first stacking platform; and a second path for conveying the sheets along the third conveyor and the second conveyor, from the entrance end of the third conveyor to the second stacking platform.

8. The stacker of claim 7, wherein second control rollers are provided at the discharge end of the second conveyor for controlling the discharge of the sheets onto the second stacking platform.

9. The stacker of claim 7, further comprising an evacuation platform arranged in an intermediate position between the first stacking bay and the second stacking bay; wherein the evacuation platform is adapted to receive stacks of sheets from at least one of the first stacking platform and the second stacking platform.

10. The stacker of claim 7, further comprising an evacuation platform arranged below the first conveyor and adapted to receive stacks of sheets from the first stacking platform.

11. The stacker of claim 7, further comprising an evacuation platform, arranged on a side of the second stacking platform opposite the first stacking platform and adapted to receive stacks of sheets from the second stacking platform.

12. The stacker of claim 7, wherein:

the first stacking platform comprises a first stacking conveyor provided with a movement in a longitudinal direction approximately parallel to the feed direction for feeding the sheets from the first conveyor to the first stacking platform;

the second stacking platform comprises a second stacking conveyor provided with a movement in a longitudinal direction approximately parallel to the feed direction for feeding the sheets from the second conveyor to the second stacking platform; and the first stacking conveyor and the second stacking conveyor are controlled so as to move a stack of sheets being formed in a direction parallel to the longitudinal direction, so as to put orders of sheets of different format over one another in such mutual position that orders formed by sheets of shorter longitudinal dimension are arranged in intermediate position relative to adjacent orders formed by sheets of longer longitudinal dimension.

13. A method for forming stacks of sheets in sequence, comprising the steps of:

conveying a flow of shingled sheets along a first conveyor extending from an entrance end to a discharge end for the sheets;

discharging sheets from the discharge end of the first conveyor onto a first stacking platform, by gradually lowering the first stacking platform moving it away from the discharge end of the first conveyor and keeping the discharge end of the first conveyor in a position where the sheets are supplied to the first stacking platform, and forming a stack of sheets on the first stacking platform;

forming a first gap in the flow of sheets along the first conveyor;

when the first gap in the flow of sheets achieves the discharge end of the first conveyor, aligning the discharge end of the first conveyor with an entrance end of a second conveyor;

conveying a flow of shingled sheets sequentially along the first conveyor and the second conveyor, that are aligned with each other, and discharging the sheets from a discharge end of the second conveyor onto a second stacking platform, by gradually lowering the second stacking platform moving it away from the discharge end of the second conveyor;

forming a second gap in the flow of sheets along the first conveyor;

when the second gap in the flow of sheets achieves the discharge end of the first conveyor, moving the discharge end of the first conveyor into a position where the sheets are supplied to the first stacking platform;

conveying the flow of shingled sheets along the first conveyor and discharging the sheets from the discharge end of the first conveyor onto the first stacking platform, by gradually lowering the first stacking platform moving it away from the discharge end of the first conveyor;

forming a third gap in the flow of sheets along the first conveyor;

when the third gap in the flow of sheets achieves the discharge end of the first conveyor, aligning the discharge end of the first conveyor with the entrance end of the second conveyor;

conveying a flow of shingled sheets sequentially along the first conveyor and the second conveyor, that are aligned with each other, and discharging the sheets from the discharge end of the second conveyor onto the second stacking platform, by gradually lowering the second stacking platform moving it away from the discharge end of the second conveyor;

wherein, after having formed the second gap, the stack of sheets formed on the second stacking platform remains in position and, after the formation of the third gap, the sheets sequentially conveyed along the first conveyor and the second conveyor, that are aligned with each other, are put over the stack previously formed on the second stacking platform.

14. The method of claim 13, further comprising the following step:

whilst the sheets move forward along the first conveyor and the second conveyor towards the second stacking platform, removing the stack of sheets formed on the first stacking platform and then lifting the first stacking platform from an evacuation position to a stacking position.

15. The method of claim 13, further comprising the following step:

whilst the sheets move forward along the first conveyor, the auxiliary conveyor and through the first control rollers toward the first stacking platform, removing the stack of sheets formed on the second stacking platform and then lifting the second stacking platform from an evacuation position to a stacking position.

16. The method of claim 13, wherein each stack of sheets is removed from the respective stacking platform onto an evacuation platform arranged between the first stacking bay and the second stacking bay.

17. The method of claim 13, wherein each stack formed on the first stacking platform and on the second stacking platform is constituted by a sequence of subsequent orders, the sheets of subsequent orders having different dimensions; and wherein the stacks being formed on at least one of the first stacking platform and second stacking platform are translated in a longitudinal direction, approximately parallel to the discharge direction for discharging the sheets onto the respective stacking platform, to mutually positioning subsequent orders stacked on the same stacking platform, so that orders formed by sheets of shorter longitudinal dimension are arranged in intermediate position relative to adjacent orders formed by sheets of longer longitudinal direction.

18. A method for forming stacks of sheets in sequence, comprising the steps of:

conveying a flow of shingled sheets along a first conveyor extending from an entrance end to a discharge end for the sheets;

discharging sheets from the discharge end of the first conveyor onto a first stacking platform, by gradually lowering the first stacking platform moving it away from the discharge end of the first conveyor and keeping the discharge end of the first conveyor in a position where the sheets are supplied to the first stacking platform, and forming a stack of sheets on the first stacking platform;

forming a first gap in the flow of sheets along the first conveyor;

when the first gap in the flow of sheets achieves the discharge end of the first conveyor, aligning the discharge end of the first conveyor with an entrance end of a second conveyor;

conveying a flow of shingled sheets sequentially along the first conveyor and the second conveyor, that are aligned with each other, and discharging the sheets from a discharge end of the second conveyor onto a second stacking platform, by gradually lowering the second stacking platform moving it away from the discharge end of the second conveyor;

forming a second gap in the flow of sheets along the first conveyor;

when the second gap in the flow of sheets achieves the discharge end of the first conveyor, moving the discharge end of the first conveyor into a position where the sheets are supplied to the first stacking platform;

conveying the flow of shingled sheets along the first conveyor and discharging the sheets from the discharge end of the first conveyor onto the first stacking platform, by gradually lowering the first stacking platform moving it away from the discharge end of the first conveyor;

wherein, after having formed the first gap and the second gap, the sheets conveyed along the first conveyor and fed to the first stacking platform are put over the stack previously formed on the first stacking platform.

19. The method of claim 18, further comprising the following step:

whilst the sheets move forward along the first conveyor and the second conveyor towards the second stacking platform, removing the stack of sheets formed on the first stacking platform and then lifting the first stacking platform from an evacuation position to a stacking position.

20. The method of claim 18, further comprising the following step:

whilst the sheets move forward along the first conveyor, the auxiliary conveyor and through the first control rollers toward the first stacking platform, removing the stack of sheets formed on the second stacking platform and then lifting the second stacking platform from an evacuation position to a stacking position.

21. The method of claim 18, wherein each stack of sheets is removed from the respective stacking platform onto an evacuation platform arranged between the first stacking bay and the second stacking bay.

22. The method of claim 18, wherein each stack formed on the first stacking platform and on the second stacking platform is constituted by a sequence of subsequent orders, the sheets of subsequent orders having different dimensions; and wherein the stacks being formed on at least one of the first stacking platform and second stacking platform are translated in a longitudinal direction, approximately parallel to the discharge direction for discharging the sheets onto the respective stacking platform, to mutually positioning subsequent orders stacked on the same stacking platform, so that orders formed by sheets of shorter longitudinal dimension are arranged in intermediate position relative to adjacent orders formed by sheets of longer longitudinal direction.

* * * * *